US012396544B2

(12) United States Patent
Barbarino

(10) Patent No.: US 12,396,544 B2
(45) Date of Patent: Aug. 26, 2025

(54) STRAP ADJUSTMENT SYSTEM FOR A COSMETIC APPLICATOR CONFIGURED FOR USERS WITH LIMITED MOBILITY

(71) Applicant: L'OREAL, Paris (FR)

(72) Inventor: Casey Barbarino, San Anselmo, CA (US)

(73) Assignee: L'OREAL, Paris (FR)

( * ) Notice: Subject to any disclaimer, the term of this patent is extended or adjusted under 35 U.S.C. 154(b) by 204 days.

(21) Appl. No.: 18/362,487

(22) Filed: Jul. 31, 2023

(65) Prior Publication Data

US 2025/0040687 A1 Feb. 6, 2025

(51) Int. Cl.

| | |
|---|---|
| ***A45F 3/00*** | (2006.01) |
| ***A45D 34/00*** | (2006.01) |
| ***A45D 40/00*** | (2006.01) |

(52) U.S. Cl.

CPC ..... *A45F 3/00* (2013.01); *A45D 34/00* (2013.01); *A45D 40/00* (2013.01); *A45F 2003/006* (2013.01)

(58) Field of Classification Search

CPC ..... A45D 2040/0006; A45D 40/18; A45D 34/00; A45D 2034/002; A45D 40/00; A45F 2005/008; A45F 2005/1013; A45F 2005/1006; A45F 2005/1073; A45F 5/00; A45F 5/10; A45F 3/00; A45F 2003/006; A45F 2003/001; A45F 2003/003; A45F 2003/142

See application file for complete search history.

(56) References Cited

U.S. PATENT DOCUMENTS

| | | | | |
|---|---|---|---|---|
| 10,342,315 | B2 * | 7/2019 | Maehr | A44C 15/005 |
| 11,517,101 | B2 * | 12/2022 | Key | A47G 21/02 |
| 12,048,358 | B2 * | 7/2024 | Morales | A45D 34/06 |
| 2020/0085168 | A1 | 3/2020 | Pang et al. | |
| 2021/0161259 | A1 * | 6/2021 | Corbellini | A44C 25/002 |

OTHER PUBLICATIONS

Preliminary Search Report and Written Opinion issued May 21, 2024, in corresponding French Patent Application No. 2311353 (with English translation of Category of Cited Documents).

* cited by examiner

*Primary Examiner* — Corey N Skurdal

(74) *Attorney, Agent, or Firm* — Womble Bond Dickinson (US) LLP

(57) ABSTRACT

A system that facilitates adjustment of a strap attached to a cosmetic applicator configured for users with limited mobility. The system allows adjustment via a single hand if needed, and can be used by users missing one or more digits. The strap adjustment system includes a housing cap, a strap, a locking feature, and a roller wheel, the locking feature disposed on a first side of a chamber formed by the housing cap and an end of the cosmetic applicator, the roller wheel disposed on a second side of the chamber, and the strap configured to pass through the chamber with the locking feature configured to contact a first side of the strap and lock the strap against locking edges of the chamber. The roller wheel is configured to unlock the strap and adjust the strap via rotation of the roller wheel.

20 Claims, 10 Drawing Sheets

STRAP ADJUSTMENT SYSTEM FOR A COSMETIC APPLICATOR CONFIGURED FOR USERS WITH LIMITED MOBILITY

FIELD

The present disclosure describes a system and features related to a device for modifying, mitigating, altering, reducing, compensation for, or the like, the movement of a cosmetic applicator caused by unintentional movements, tremors, limited mobility, or the like of a user.

BACKGROUND

Unintentional movements of the human body, or human tremors, can occur in individuals suffering from motion disorders or even healthy individuals. Due to these unintentional movements, a person may have difficulty in performing a task that requires care and precision, such as applying a cosmetic composition to a part of the body, such as the face, hands, or feet.

Therefore, there is a need for a solution that allows application of a cosmetic composition that is compatible with the diverse and disposable nature of cosmetic applicators.

SUMMARY

In one embodiment, the present disclosure relates to a strap adjustment system for a cosmetic applicator configured for users with limited mobility, including a housing cap disposed at an end of the cosmetic applicator, the housing cap and the end of the cosmetic applicator forming a chamber including a first opening and a second opening; a strap attached to the cosmetic applicator at a first end of the strap, a second end of the strap configured to pass through the first opening and the second opening; a locking feature disposed on a first side of the chamber and configured to (i) contact a first side of the strap, (ii) bias the strap in a first direction away from the first side of the chamber via a locking force, and (iii) force a second side of the strap to abut a first locking edge and a second locking edge of the chamber formed, the first locking edge formed as part of the first opening of the chamber and second locking edge formed as part of the second opening of the chamber, the locking force preventing translation of the strap through the chamber; and a roller wheel disposed on a second side of the chamber opposite the first side of the chamber, the roller wheel configured to (i) abut the second side of the strap when an unlocking force is applied in a second direction opposite the first direction to force the roller wheel into an engaged state, the unlocking force being sufficient to overcome the locking force applied by the locking feature and allow the strap to translate through the chamber, (ii) rotate in the engaged state to translate the strap through the chamber, and (iii) return to an unengaged state where the roller wheel does not provide sufficient unlocking force to overcome the locking force applied by the locking feature on the strap.

In an embodiment, the locking feature is a reversibly deformable structure configured to apply the locking force in the first direction via a spring force.

In an embodiment, the locking feature is a magnet configured to apply the locking force in the first direction via a magnetic force.

In an embodiment, the strap is reversibly deformed in the chamber via the locking force applied by the locking feature, the deformation of the strap increasing a friction force between the strap at the first locking edge and the second locking edge.

In an embodiment, the roller wheel is reversibly biased away from the strap in the first direction.

In an embodiment, the roller wheel includes an axle disposed through a rotation axis of the roller wheel, a first end of the axle and a second end of the axle being disposed in a first axle housing and a second axle housing, respectively, formed as part of the second side of the chamber, the first axle housing and the second axle housing each including an elongated opening along the first and second direction through which the first end of the axle and the second end of the axle can travel between the engaged and unengaged states of the roller wheel.

In an embodiment, the roller wheel is arranged on a swiveling platform formed as part of the second side of the chamber, the swiveling platformed configured to rotate about an axis orthogonal to a rotation axis of the roller wheel and rotate the roller wheel along a direction of an applied force applied to the roller wheel.

In an embodiment, the strap includes friction features on the second side of the strap configured to provide additional resistance force against translation of the strap through the chamber.

In an embodiment, the roller wheel includes complementary friction features as the friction features on the second side of the strap, the complementary friction features of the roller wheel being disposed on a surface of the roller wheel and configured to abut and mate with the friction features of the strap.

In an embodiment, the roller wheel is configured to translate the strap to a first resistance checkpoint.

In an embodiment, the first end of the strap is attached to the cosmetic applicator via an adjustable strap attachment configured to reversibly translate in the first direction and the second direction.

In an embodiment, after reaching the first resistance check point, the roller wheel is configured to further translate the strap through the chamber and adjust an arrangement of the adjustable strap attachment along the first and second direction.

In an embodiment, the roller wheel is configured to translate the strap to a second resistance checkpoint after which a tightness of the strap around an object disposed within a loop of the strap cannot be tightened further.

The present disclosure additionally relates to a method of adjusting a strap in a strap adjustment system for a cosmetic applicator configured for users with limited mobility, including applying an unlocking force towards a housing cap disposed at an end of the cosmetic applicator, the housing cap and the end of the cosmetic applicator forming a chamber including a first opening and a second opening, the strap attached to the cosmetic applicator at a first end of the strap, a second end of the strap configured to pass through the first opening and the second opening, the strap adjustment system additionally including a locking feature disposed on a first side of the chamber and configured to (i) contact a first side of the strap, (ii) bias the strap in a first direction away from the first side of the chamber via a locking force, and (iii) force a second side of the strap to abut a first locking edge and a second locking edge of the chamber formed, the first locking edge formed as part of the first opening of the chamber and second locking edge formed as part of the second opening of the chamber, the locking force preventing translation of the strap through the chamber, and a roller wheel disposed on a second side of the chamber opposite the first side of the chamber, the roller wheel configured to (i) abut the second side of the strap when the unlocking force is applied in a second direction opposite the first direction to force the roller wheel into an engaged state, the unlocking force being sufficient to overcome the locking force applied by the locking feature and allow the strap to translate through the chamber, (ii) rotate in the engaged state to translate the strap through the chamber, and (iii) return to an unengaged state where the roller wheel does not provide sufficient unlocking force to overcome the locking force applied by the locking feature on the strap; and while applying the unlocking force towards the housing cap sufficient to overcome the locking force, applying a lateral force to rotate the roller wheel and translate the strap through the chamber.

BRIEF DESCRIPTION OF THE DRAWINGS

A more complete appreciation of the embodiments and many of the attendant advantages thereof will be readily obtained as the same becomes better understood by reference to the following detailed description when considered in connection with the accompanying drawings, wherein.

DETAILED DESCRIPTION

The present disclosure describes a cosmetic applicator system that minimizes, modifies, mitigates, alters, reduces, compensates for, or the like unintentional movements by stabilizing, orienting, operating, controlling, etc. an applicator for a user and is also designed to be flexible to accommodate different types of commercially available cosmetic applications. The present disclosure further describes a system and features to enhance the functionality of such a cosmetic applicator system.

The basic features and operation of a motion stabilizing device for a cosmetic applicator is described in U.S. Pat. No. 11,458,062, which is incorporated herein by reference.

Figure 1:
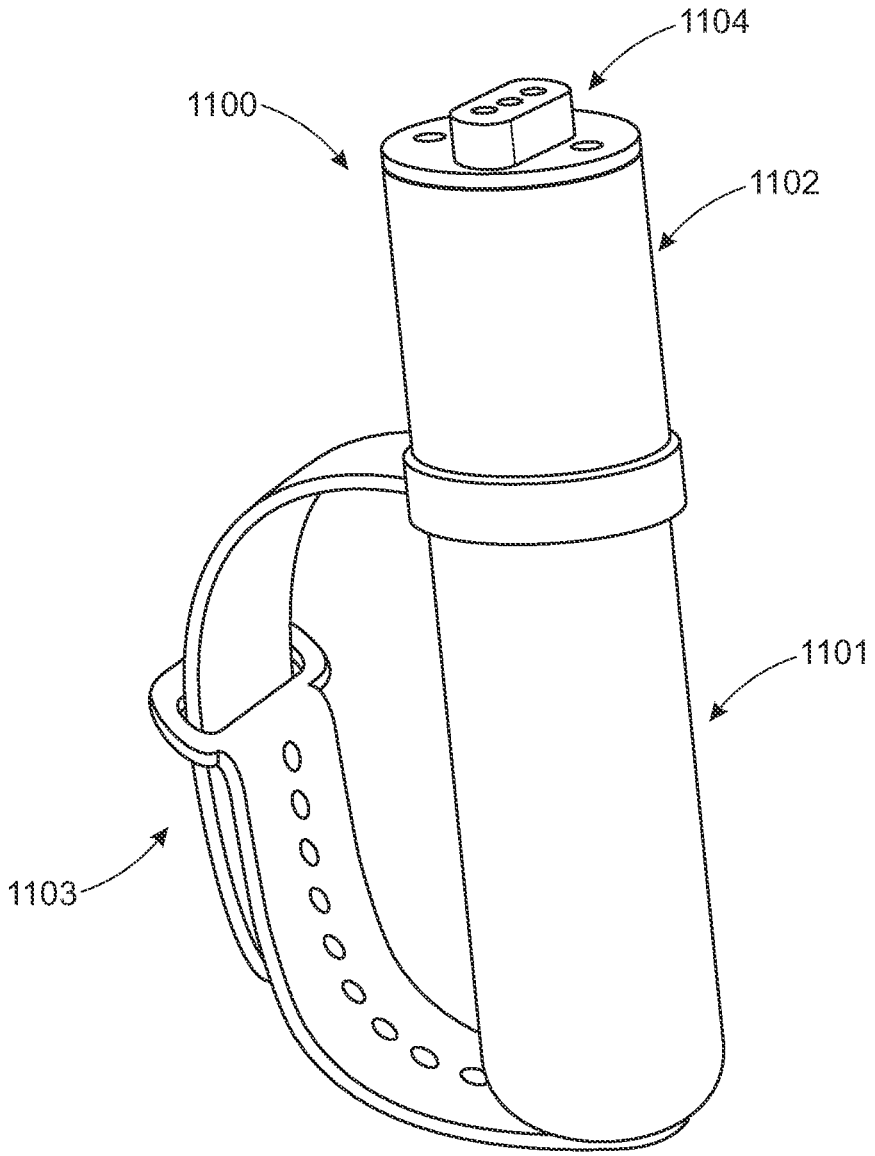
FIG. 1 shows a motion stabilizing device, according to an embodiment of the present disclosure.

FIG. 1 shows a conventional motion stabilizing device 1100, which serves as a base unit for receiving a cosmetic applicator according to an embodiment. The device 1100 includes a handle portion 1101, a receiver portion 1102, and a strap 1103. The receiver portion 1102 includes an interface 1104, shown as a male connector that couples with a cosmetic applicator, which will be discussed in detail below. The receiver portion could be utilized for communication between the base unit and the applicator. The connection to an adaptor and/or an applicator could be accomplished with a mechanical coupling, such as screw-in or snap-fit, or it could be accomplished with magnets.

Figure 2:
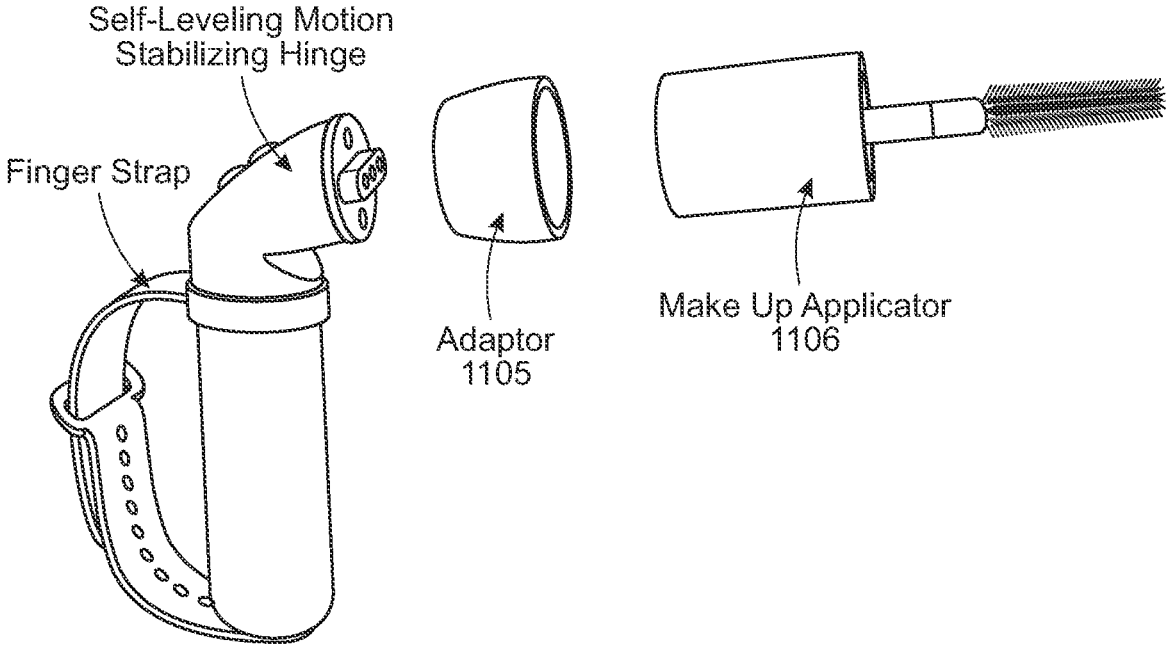
FIG. 2 shows how the motion stabilizing device couples with an adaptor and a make-up applicator, according to an embodiment of the present disclosure.

FIG. 2 shows how the device 1100 couples with an adaptor 1105 and a make-up applicator 1106. It can be seen that the adaptor fits over the exposed end of the receiver portion 1102. The adaptor includes electrical mating connectors (a female connector—not shown) in a recessed portion to make contact with the electric interface of the receiver portion 1101.

As shown in FIG. 2, the receiver portion 1102 is configured to contort, articulate, reposition, etc., between an upright posture (as shown in FIG. 1) and an angled posture (as shown in FIG. 2). This is accomplished with a hinge mechanism contained inside the receiver portion 1102. FIG. 2 shows that the hinge mechanism is a self-leveling/motion stabilizing hinge.

Figure 3A:
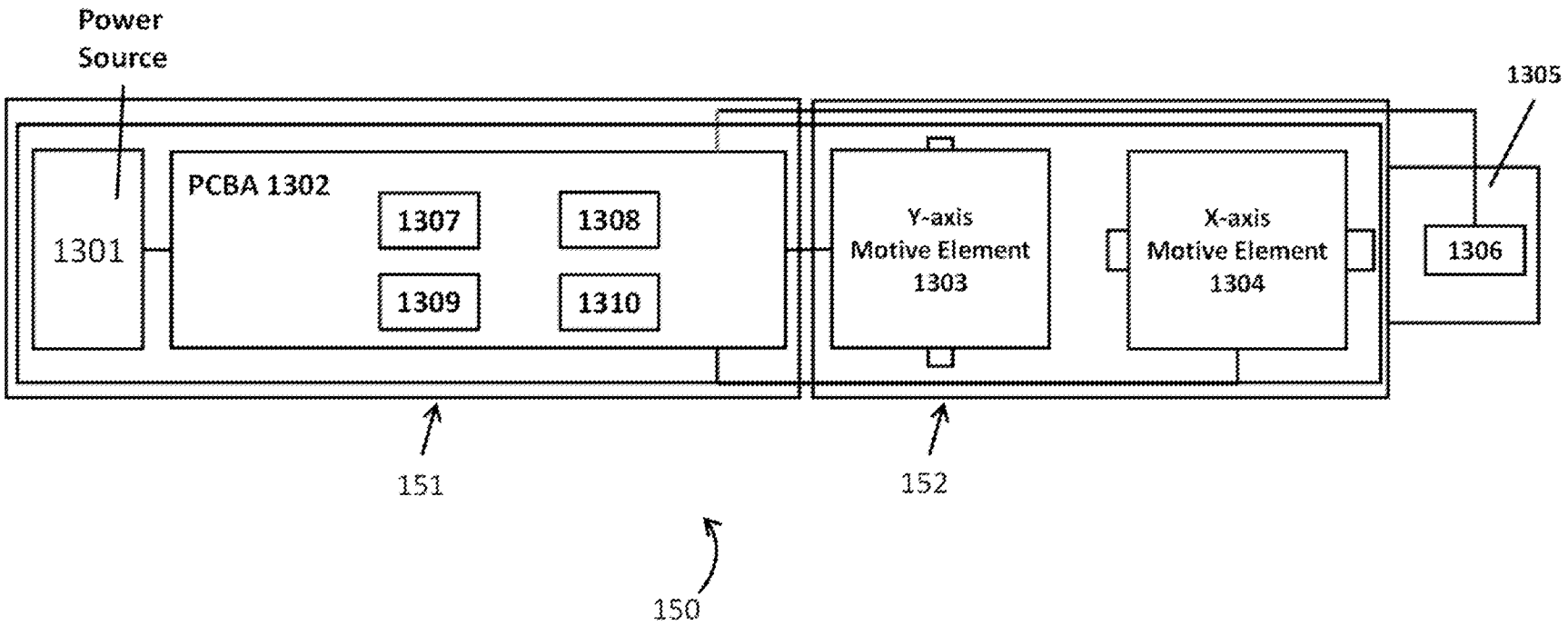
FIG. 3A shows a diagram of the internal components of a motion stabilizing, according to an embodiment of the present disclosure.

FIG. 3A shows a diagram of the internal components of device 1100 according to one embodiment. In the handle portion, the device includes a power source 1301, which may be a battery or the like. The device includes a printed circuit board assembly (PCBA) 1302, which may include positional sensor circuitry 1307, reader circuitry 1308, control circuitry 1309, and communication interface 1310, as understood in the art.

For instance, as the sensor circuitry 1307, the PCBA may include at least one inertial sensor and at least one distributed motion sensor to detect unintentional muscle movements and measure signals related to these unintentional muscle movements that are created when a user adversely affects motion of the applicator. These sensors also detect the motion of the stabilized output relative to device. The control circuitry sends voltage commands in response to the signals to the motion generating elements (described below) to cancel the user's tremors or unintentional muscle movements. This cancellation maintains and stabilizes a position of the applicator, keeping it stable.

One of ordinary skill in the art readily recognizes that a system and method in accordance with the present invention may utilize various implementations of the control circuitry and the sensor circuitry and that would be within the spirit and scope of the present invention. In one embodiment, the control circuitry 1309 comprises an electrical system capable of producing an electrical response from sensor inputs such as a programmable microcontroller or a field-programmable gate array (FPGA). In one embodiment, the control circuitry comprises an 8-bit ATMEGA8A programmable microcontroller manufactured by Atmel due to its overall low-cost, low-power consumption and ability to be utilized in high-volume applications.

In one embodiment, the at least one inertial sensor in the sensor circuitry is a sensor including but not limited to an accelerometer, gyroscope, or combination of the two. In one embodiment, the at least one distributed motion sensor in the sensor circuitry is a contactless position sensor including but not limited to a hall-effect magnetic sensor.

The system created by the combination of the sensor circuitry, the control circuitry, and the motion generating elements may be a closed-loop control system that senses motion and acceleration at various points in the system and feeds detailed information into a control algorithm that moves the motion-generating elements appropriately to cancel the net effect of a user's unintentional muscle movements and thus stabilize the position of the applicator. The operation and details of the elements of the control system and control algorithm are understood in the art, as described in U.S. PG Publication 2014/0052275A1, incorporated herein by reference.

The communication interface 1310 may include a network controller such as BCM43342 Wi-Fi, Frequency Modulation, and Bluetooth combo chip from Broadcom, for interfacing with a network.

In the receiver portion of the device, there may be two motive elements to allow 3-dimensional movement of the receiver as anti-shaking movement. The two motive elements include a y-axis motive element 1303 and an x-axis motive element 1304, each being connected to and controlled by the PCBA 1302. Each of the motive elements may be servo motors as understood in the art. The device further includes end effector coupling 1305, which is configured to couple with the adaptor 1105. The end effector coupling 1305 may include a radiofrequency identification (RFID) reader 1306, configured to read an RFID tag, which may be included with the applicator, as will be discussed below.

Figure 3B:
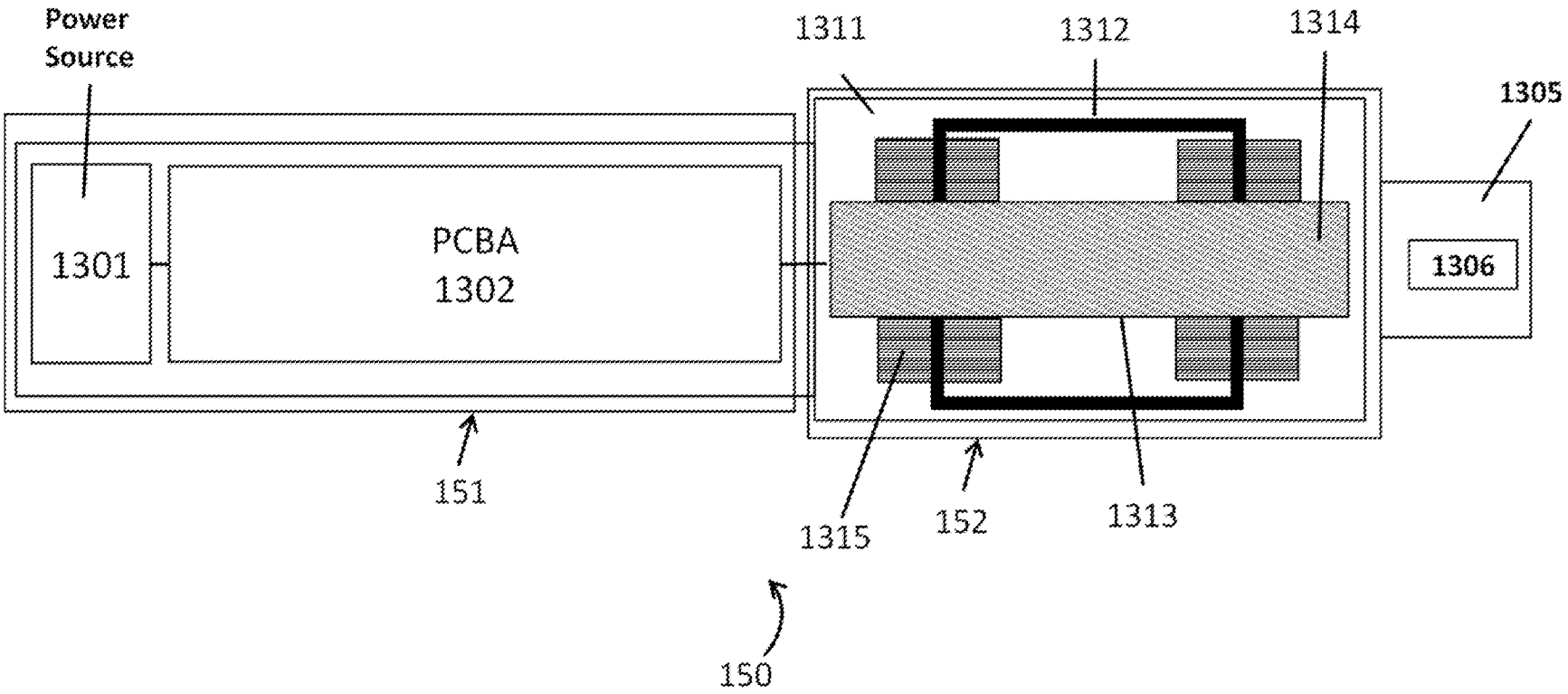
FIG. 3B shows a diagram of an alternative embodiment of the motion stabilizing device in which a receiver portion includes an electromagnetic positioner, according to an embodiment of the present disclosure.

FIG. 3B shows a diagram of an alternative embodiment of the device 1100 in which the receiver portion includes an electromagnetic positioner 1311 instead of the motive elements shown in FIG. 3A. The electromagnetic positioner 1311 may include U-shaped magnetic cores 1312 arrayed around a non-magnetic tube 1313, which is filled with a magnetic fluid 1314. Each of the magnetic cores has arm portions that are surrounded by windings 1315. The magnetic cores may be controlled by the control circuitry in the PCBA 1302 to act as a controllable active magnetic field-generating structure which is used to generate a variable magnetic field that acts upon the magnetic fluid, causing it to be displaced, thereby enabling the armature to be moved to a desired coordinate position and/or orientation. The details of implementing the electromagnetic positioner 1311 may be found in U.S. Pat. No. 6,553,161, which is incorporated herein by reference.

In the above-described conventional motion stabilizing device, there is a problem that the interface 1104 that receives the adaptor 1105 requires a specific point of attachment to align properly with the interface.

Therefore, the below embodiments provide a universal adapter connection between the handle of the motion stabilizing device in order to improve user experience and reduce the struggle and time taken to set up the system for use.

In one embodiment, the present disclosure is directed towards a cosmetic applicator. The cosmetic applicator can be used for a variety of cosmetics and cosmetic applications, including, but not limited to, mascara, eyeliner, eyebrow products, lip products (lipstick, lip gloss, lip liner, etc.), skin products, and/or hair products. In one embodiment, the cosmetic applicator can include an adapter, wherein the adapter can connect the cosmetic applicator to a motion stabilizer. The motion stabilizer can be, for example, a handle that can counteract unintentional motions such as tremors or spasms. These motions can interfere with the application of cosmetics and can also make it difficult to generally interact with cosmetic applicators or tools. For example, the many cosmetic products require a twisting motion or force to be applied to open or extrude the product. It can be difficult for users to achieve the range of motion or the precision necessary to apply these forces to the cosmetic. In one embodiment, the cosmetic applicator can hold a cosmetic and can enable the proper force to be applied to the cosmetic to open, close, mix, stir, blend, extrude, or achieve other similar functions necessary for application.

Figure 4:
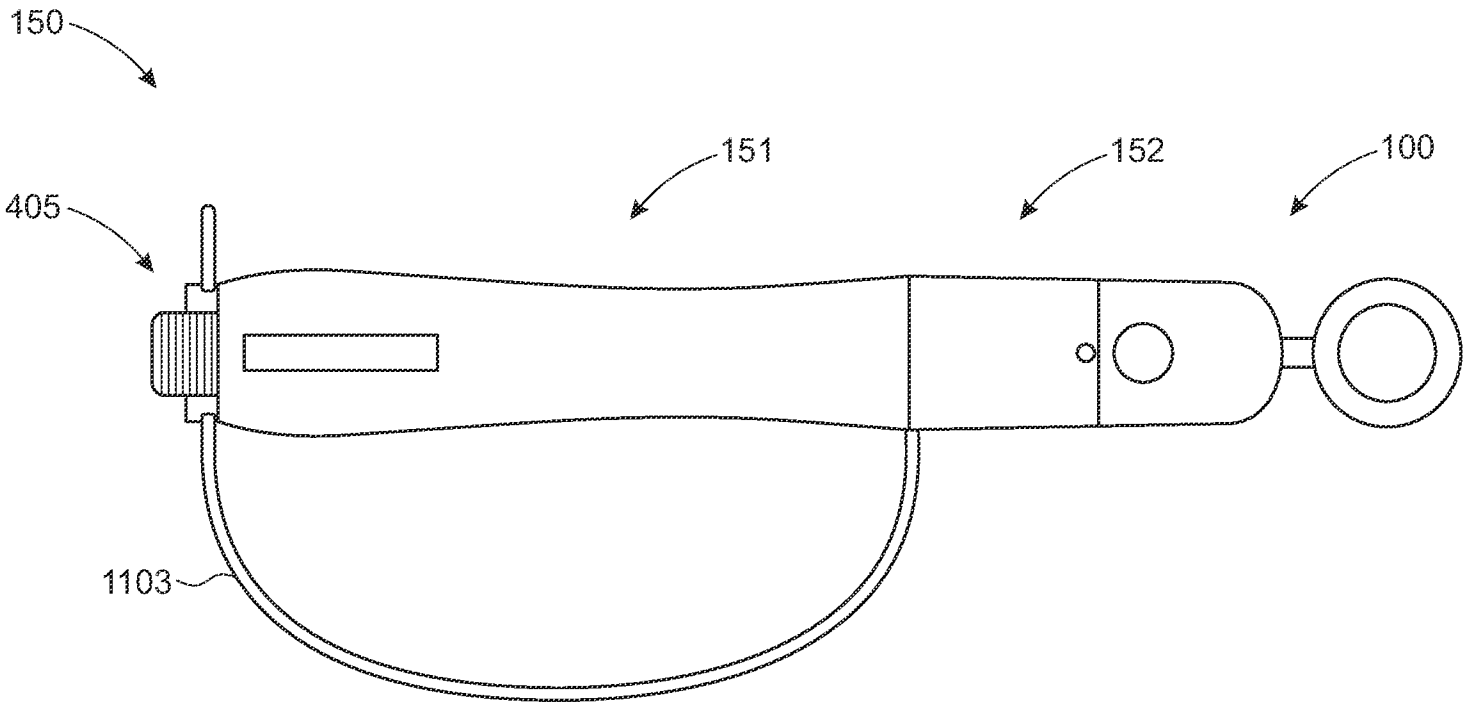
FIG. 4 shows an overview of a universal adapter handle connection system, according to an embodiment of the present disclosure.

FIG. 4 shows an overview of a cosmetic securement device including a motion stabilizer device 150 and a cosmetic adapter 100, according to one embodiment of the present disclosure. The motion stabilizer device 150 can include at least one of a handle portion 151 and a hinge portion 152 (receiver portion). In an embodiment, the handle portion 151 is functionally similar to the handle portion 1101 shown in FIG. 1. In an embodiment, the receiver portion 152 is functionally similar to the receiver portion 1102 shown in FIG. 1. The motion stabilizer device 150 as a whole is referred to as a motion stabilizer handle. In an embodiment, the cosmetic securement device includes a cosmetic adapter 100, wherein the adapter 100 is coupled to the receiver portion 152 of the motion stabilizer device 150. The cosmetic adapter 100 is configured to hold a cosmetic tool or product. In one embodiment, the cosmetic adapter 100 comprises a universal adapter configured to hold different types of cosmetic products. For example, the adapter 100 can include a ring-shaped holder. Various configurations of the adapter 100 can be used for different cosmetics and tools. For example, the shape and dimensions of the cosmetic holder can be configured for different cosmetic products. The adapter 100 can be easily attached to and removed from the motion stabilizer device. The basic features and operation of the cosmetic securement device of FIG. 4 are described in co-pending U.S. patent application Ser. Nos. 18/091,882; 18/091,920; 18/091,843; 18/091,925; 18/148,957; and Ser. No. 18/148,880; and Ser. No. 18/148,930, which are incorporated herein by reference.

In one embodiment, the adapter 100 is coupled to the receiver portion 152 of the motion stabilizer device 150 via a magnetic attachment. The base or bottom end of the adapter 100 forms a chamber that can fit over a projection at the tip of the receiver portion 152. The base of the adapter includes at least one magnet, wherein the at least one magnet can be attracted to and attach to a magnet in the receiver portion 152. In one embodiment, the chamber formed at the base of the adapter 100 can fit over the receiver portion 152 in more than one orientation. The chamber can be a hollow area within the body of the adapter that is fully contained by the walls of the adapter 110. The chamber can be approximately conical in shape. In one embodiment, the chamber is cylindrical. The chamber can be configured to fit over a projection on one end of the motion stabilizer. The chamber can be used to align and guide the attachment of the cosmetic applicator to the motion stabilizer. The fit of the chamber over and around the projection on the end of the motion stabilizer limits lateral motion that would misalign the cosmetic applicator and the motion stabilizer. It can be easier for a user to align the chamber over the end of the motion stabilizer than it would be for the user to align the edges of a circular face of the adapter with the edges of a circular face of the motion stabilizer. The chamber can have rotational symmetry such that the cutout can be placed over the end of the motion stabilizer in any orientation or at any degree of rotation around the axis of the chamber. In one embodiment, the bottom end of the adapter body can include additional physical structures that can align, guide, and fix the adapter to the motion stabilizer.

In one embodiment, one or more motion stabilization components is placed in an internal sleeve, wherein the internal sleeve can be inserted into the motion stabilizer device 150. In one embodiment, the motion stabilizer device 150 can be a hollow shell (e.g., cylindrical shell), and the internal sleeve containing motion stabilization components can be a cylindrical sleeve with a diameter that is smaller than the diameter of the motion stabilizer device 150. The motion stabilization components can be located in the internal sleeve can be located in alignment with the positions illustrated in FIG. 3A and FIG. 3B.

In one embodiment, the internal sleeve can form a receptacle for one or more motion stabilization components. For example, the internal sleeve can form cutouts along the length of the sleeve, the cutouts being sized for the one or more motion stabilization components. Each motion stabilization component can be placed or embedded in a cutout to be secured in the internal sleeve. In one embodiment, the internal sleeve can be a hollow cylinder, wherein motion stabilization components is placed inside the hollow cylinder. The internal sleeve can enable placement of the motion stabilization components in the motion stabilizer device and removal of the motion stabilizer components from the motion stabilizer device as needed. In one embodiment, the cosmetic securement device can include a locking mechanism and/or an eject mechanism to secure and release the internal sleeve and the motion stabilizer components contained therein.

In one embodiment, the motion stabilizer device 150 can include a strap adjustment system 405 disposed at an end of the handle portion 151. Many users with disabilities can struggle to use both hands, as well as using a pinching motion or similar motion. Therefore, it can be difficult to adjust the strap 1103 using a pull or push motion with a single hand. Thus, the strap adjustment system 405 can be configured to adjust a fit of the strap 1103 around a hand of the user without the need of fine, dexterous manipulations. The strap 1103 can be attached or secured to the motion stabilizer device 150 at a first end of the strap 1103, and the strap adjustment system 405 can receive a second end of the strap 1103 through one or more openings and adjust an amount of the strap 1103 pulled or pushed through the one or more openings. In doing so, a size of a loop formed between the motion stabilizer device 150 and the strap 1103 can be adjusted to be narrower or wider by the strap adjustment system.

The first end of the strap 1103 can be attached or secured to, for example, the handle portion 151 or the receiver portion 152. The location of the attachment of the first end of the strap 1103 can be modified based on a shape or structure of the motion stabilizer device 150 in order to fit a width of most user's hands for a single attachment location. Additionally or alternatively, the location of the attachment of the first end of the strap 1103 can be dynamic or adjustable in order to allow further customization according to the width of the user's hand. The width of the user's hand can be defined as, for example, a distance measuring across a palm of the user's hand in a direction perpendicular to a length axis of the arm. That is, the width of the hand can be measured from a pinkie finger to a pointer finger at the outer-most edges of said fingers. Upon grasping the motion stabilizer device 150, the strap 1103 can be disposed along a back of the user's hand (opposite the palm side). In most cases, the user can arrange the user's thumb external to the loop in order to wrap the thumb around the handle portion 151, but cases where the user arranges the user's thumb inside the loop can occur as well. Additional cases can occur where, for example, the user does not have a thumb or other fingers, and the strap 1103 can be adjusted accordingly for a better fit without dexterous manipulations.

Figure 5:
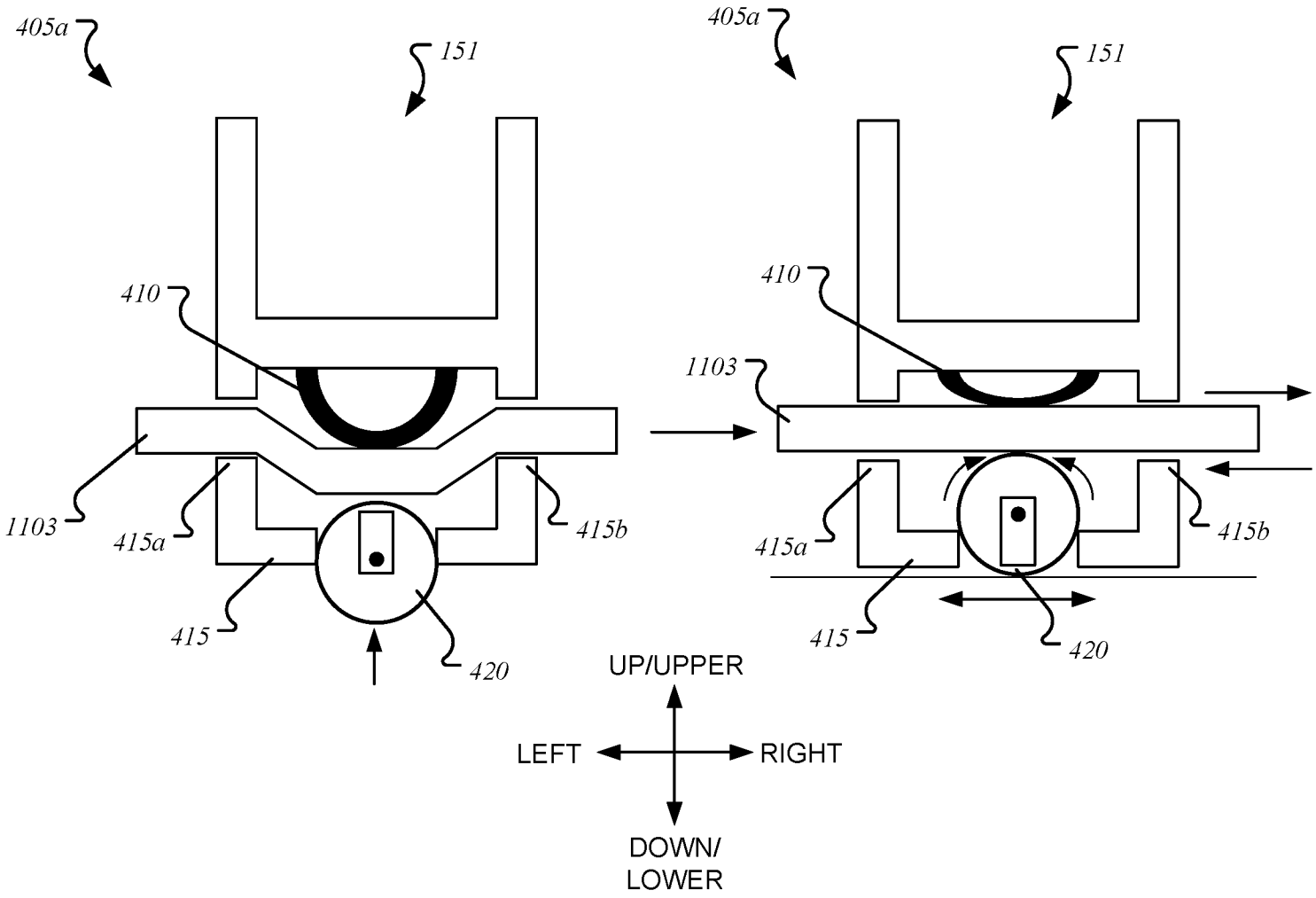
FIG. 5 shows an illustration of a strap adjustment system with friction locks, according to an embodiment of the present disclosure.

FIG. 5 shows an illustration of a strap adjustment system 405*a* with friction locks, according to an embodiment of the present disclosure. In an embodiment, the strap adjustment system 405*a* includes a locking spring 410, a housing cap 415, and a roller wheel 420. The strap 1103 passes through a first opening and a second opening formed between the handle portion 151 and the housing cap 415. The locking spring 410 and the roller wheel 420 are disposed between the first opening and the second opening in a chamber of the strap adjustment system 405*a*. The locking spring 410 is attached to a first side of the chamber proximal to the handle portion 151, and the roller wheel 420 is attached to a second side of the chamber proximal to the housing cap 415. The roller wheel 420 includes an axle around which the roller wheel 420 rotates. The axle can be secured at one or both ends to the housing cap 415. For example, a first end of the axle and a second end of the axle are disposed in a first axle housing and a second axle housing formed as part of the second side of the chamber, the first axle housing and the second axle housing each including an elongated opening spanning along the first and second direction through which the first end of the axle and the second end of the axle can travel between the engaged and unengaged states of the roller wheel 420. The axle, and therefore the roller wheel 420, is configured to move along a direction towards or away from the locking spring 410 (up-down direction). The roller wheel 420 is configured to contact the strap 1103 along a first side of the strap 1103, the first side being opposite a second side of the strap 1103 configured to contact the locking spring 410.

As shown in FIG. 5 on the left, the locking spring 410 applies a force (downwards force) against the second side of the strap 1103 towards the housing cap 415 and the roller wheel 420, which causes the strap 1103 to deform along a portion of the strap 1103 disposed inside the chamber. For example, the locking spring 410 can be biased towards the strap 1103 via a stored spring force or a magnetic force. For example, the locking spring 410 is a magnet biased towards the strap 1103 via the magnetic force (e.g., the magnetic force is generated via a same polarity magnet pole disposed proximal to the locking spring 410 magnet pole biasing the locking spring 410 towards the strap 1103).

In an embodiment, the strap 1103, when deformed and forced down towards the housing cap 415, abuts a first locking edge 415*a* of the housing cap 415 at a first location of the strap 1103 and a second locking edge 415*b* of the housing cap at a second location of the strap 1103. The abutment of the strap 1103 at the first locking edge 415*a* and the second locking edge 415*b* results in sufficient friction force to prevent translation of the strap 1103 (left or right motion). The first locking edge 415*a* and the second locking edge 415*b* are formed as part of the housing cap 415 and as part of the first opening and the second opening. Although shown as smooth, the first side and/or the second side of the strap 1103 can include ridges, bumps, serrations, valleys, etc. or other friction features to provide additional resistance to translation when the strap 1103 abuts the first locking edge 415*a* and the second locking edge 415*b*. The same friction features or complementary features can be formed on a surface of the locking spring 410 to further resist translation of the strap 1103. The same features or complementary features can be formed on a surface of the roller wheel 420 to assist in translation of the strap 1103 via the roller wheel 420. Further, it may be appreciated that only one of the first locking edge 415*a* or the second locking edge 415*b* can be configured to prevent the strap 1103 from translating. It may be appreciated that additional locking edges can be used to prevent the strap 1103 from translating.

In an embodiment, on the right of FIG. 5, the roller wheel 420 can be forced towards the handle portion 141 (upwards) to engage the strap 1103, straighten the strap 1103, and depress the locking spring 410. In an embodiment, the upwards motion reduces the friction between the strap 1103 and the first locking edge 415 and the second locking edge 415*b* to allow translation of the strap 1103 left or right. The translation of the strap 1103 left or right is achieved by rolling the roller wheel left or right while forcing the roller wheel 420 upwards. For example, the user can grasp the motion stabilizer device 150 along the handle portion 151, arrange the roller wheel 420 on a flat surface, such as a table, and apply a force towards the flat surface while sliding the motion stabilizer device 150 along the left or right direction. Of course, left and right directions are described, but other opposing directions can be used. For example, the user can be sitting and arrange the roller wheel 420 on a leg of the user, then push away from or pull towards the user's body. For example, the user can arrange the roller wheel 420 on a vertical surface, then move the motion stabilizer device 150 up or down.

In an embodiment, the roller wheel 420 is configured to rotate around an axis of the motion stabilizer device 150 (the up-down axis as shown) such that any motion by the user will translate the strap 1103 to tighten or loosen the strap 1103 around the user's hand. For example, the roller wheel 420 can be mounted on a swiveling platform formed as part of the housing cap 415. This can be especially helpful when the user has a reduced range of motion and can only move the motion stabilizer device 150 along a predetermined direction which is not parallel to the translation direction of the strap 1103. Therefore, the roller wheel 420 is configured to swivel and then roll along the axis of motion of the user, and the roller wheel 420 is mated to one or more additional roller wheels, gears, and screws to convert the rolling motion of the roller wheel 420 into translation of the strap 1103.

As described above, the translation of the strap 1103 left or right via the roller wheel 420 results in a tightening or loosening of the strap 1103 around the user's hand. For example, since the strap 1103 is attached to the motion stabilizer device 150 at the first end of the strap 1103, the pulling of the strap 1103 at the second end of the strap 1103 through the chamber tightens the strap 1103. Conversely, applying the opposite force or motion (pushing the second end back through the chamber) loosens the strap 1103. Upon releasing the force biasing the roller wheel 420 towards the locking spring 410, the locking spring 410 once again deforms the strap 1103 inside the chamber towards the roller wheel 420 and forces the strap 1103 to abut the first locking edge 415*a* and the second locking edge 415*b* to lock the strap 1103 at the current setting and tightness. Furthermore, for the strap 1103 with the first end of the strap 1103 adjustably or dynamically attached to the motion stabilizer device 150, the user can tighten the strap 1103 to a first resistance checkpoint where the strap 1103 is taught against the back of the user's hand (e.g., by rolling the roller wheel 420). Then, additional rolling of the roller wheel 420 results in translation of the attachment point of the first end of the strap 1103 towards the housing cap 415. This reduces a diameter of the loop along an axis of the motion stabilizer device 150 for a more secure or snug fit with a narrow width around the user's hand.

Figure 6:
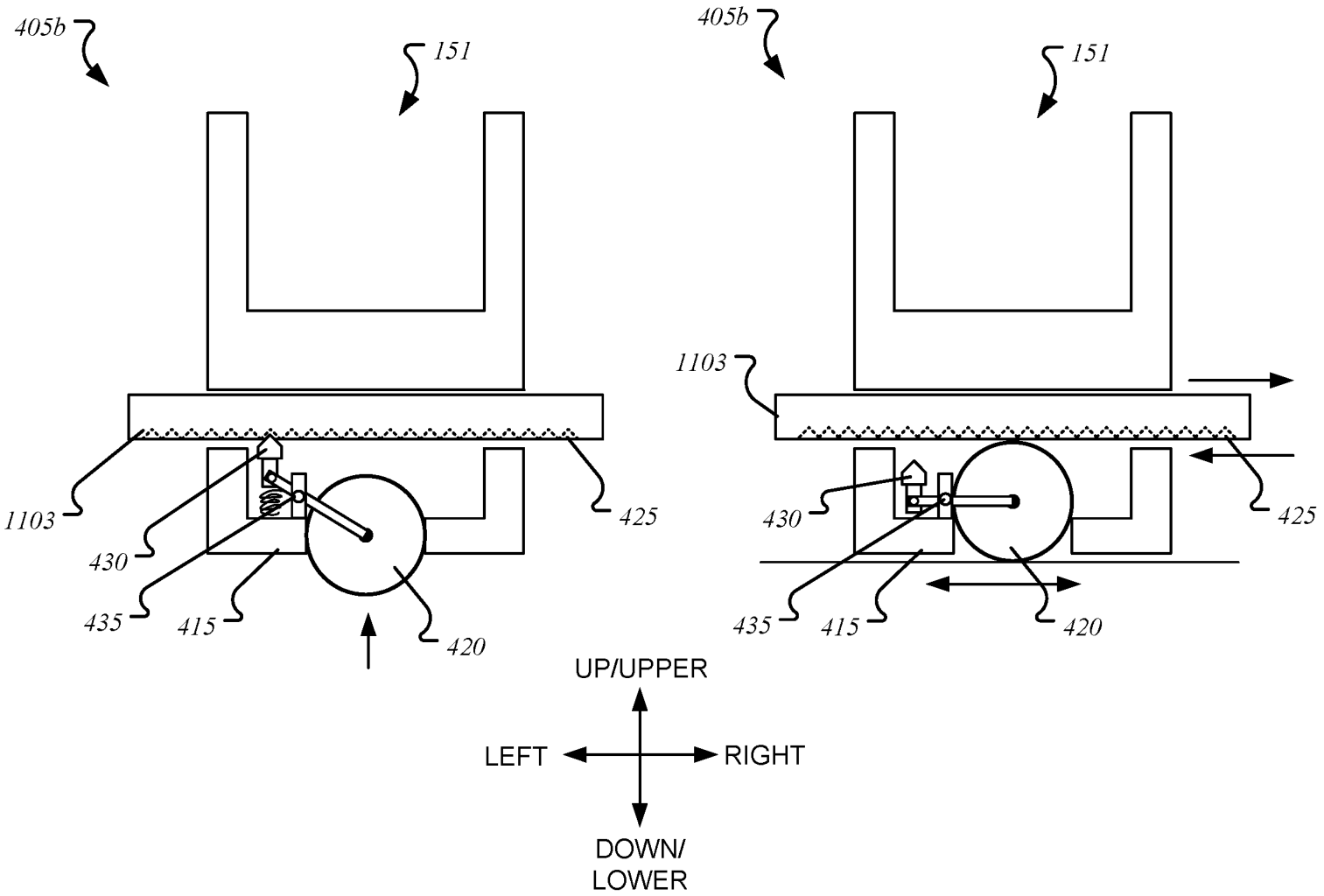
FIG. 6 shows an illustration of a strap adjustment system with a locking pin, according to an embodiment of the present disclosure.

FIG. 6 shows an illustration of a strap adjustment system 405*b* with a locking pin 430, according to an embodiment of the present disclosure. In an embodiment, the strap adjustment system 405*b* includes the locking pin 430, a fulcrum 435, the housing cap 415, and the roller wheel 420. The strap 1103 passes through the first opening and the second opening formed between the handle portion 151 and the housing cap 415. The locking pin 430 and the roller wheel 420 are disposed between the first opening and the second opening in the chamber. Notably, the strap 1103 is not deformed or deflected in the chamber to prevent movement of the strap 1103.

In an embodiment, the strap 1103 includes teeth on the first side and the locking pin 430 has a complementary shape to the teeth. The locking ping 430 is configured to abut and mate with one of the teeth when in a locked or engaged position. The locking pin 430 can be attached to a lever arm on a first end with the roller wheel 420 attached to a second end of the lever arm. The fulcrum 435 is disposed between the locking pin 430 and the roller wheel 420, and the lever arm is attached to the fulcrum 435. Therefore, the lever arm pivots about the attachment point on the fulcrum 435 and causes the locking pin 430 and the roller wheel 420 to move in opposite directions to one another. As shown in FIG. 6, when the roller wheel 420 is moved in a direction towards the strap 1103 (upwards), the locking pin 430 can move away from the strap 1103 (downwards) and disengage from the teeth. Notably, a force can be applied to bias the locking pin 430 towards the strap 1103 (upwards), such as a spring force or a magnetic force, which then constantly biases the roller wheel 420 away from the strap 1103 (downwards) via the fulcrum 430 pivot point.

Again, the roller wheel 420 includes the axle around which the roller wheel 420 rotates. The axle here is attached at one or both ends to the lever arm (or lever arms when the axle is attached at both ends of the axle). The roller wheel 420 is configured to contact the strap 1103 along the first side of the strap 1103. In an embodiment, the roller wheel 420 includes teeth as well that are complementary in shape to the teeth on the strap 1103, thereby providing a more secure translation of the strap 1103 when the roller wheel 420 is forced upwards to contact the strap 1103 and subsequently rotate left or right to tighten or loosen the strap 1103.

In an embodiment, when the roller wheel 420 is forced to contact the strap 1103, the locking pin 430 disengages or moves to an unlocked position due to the fulcrum, which allows the strap 1103 to move freely. At the same time, the roller wheel 420 comes into contact with the strap and, when a force is applied to rotate the roller wheel 420, the roller wheel 420 translates the strap 1103 left or right. For example, as previously described, the user can set the motion stabilizer device 150 down on a flat surface with the roller wheel 420 end of the motion stabilizer device 150 proximal to the flat surface. Then, the user pushes down with additional force to depress the roller wheel 420 in a direction towards the strap 1103, which releases the locking pin 430 from the strap 1103. Then, the user moves the motion stabilizer device 150 left or right to tighten or loosen the strap 1103 around the user's hand. Upon reaching a desired fit for the strap 1103, the user lifts the motion stabilizer device 150 off of the flat surface, which (via the spring force biasing the locking pin 430 towards the strap 1103) moves the locking pin 430 back into the locked or engaged position and prevents the strap 1103 from adjusting further.

Figure 7:
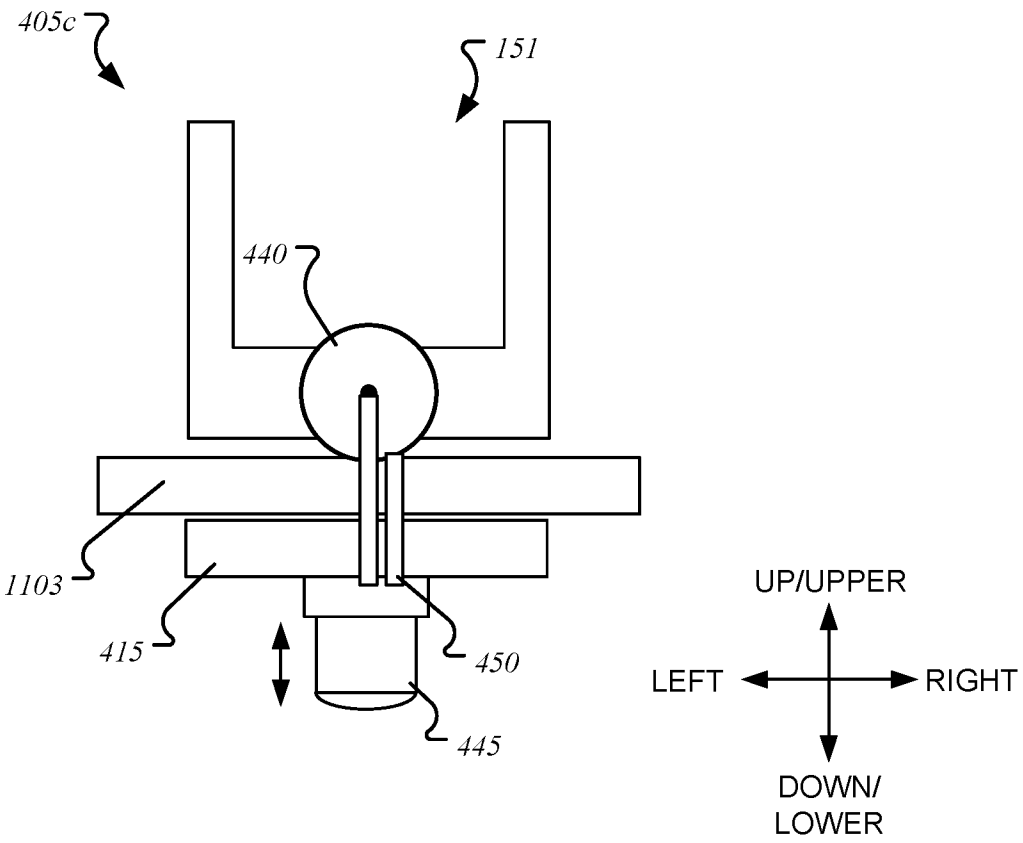
FIG. 7 shows an illustration of a strap adjustment system with a ratchet button, according to an embodiment of the present disclosure.

FIG. 7 shows an illustration of a strap adjustment system 405*c* with a ratchet button 445, according to an embodiment of the present disclosure. In an embodiment, the strap adjustment system 405*c* includes the ratchet button 445, a ratchet wheel 440, and a locking pawl 450. The strap 1103 passes through the first opening and the second opening formed between the handle portion 151 and the housing cap 415. The ratchet wheel 440 is disposed adjacent to the strap 1103, such as disposed along the handle portion 151, and contacts the strap 1103 on the second side of the strap 1103 (as shown). In an embodiment, the ratchet wheel 440 is disposed along the housing cap 415 and contacts the strap 1103 on the first side of the strap 1103. As shown, the ratchet wheel 440 pushes the strap 1103 towards the housing cap 415 to achieve sufficient friction between the ratchet wheel 440 and the strap 1103. As described previously, the strap 1103 can optionally include the teeth that can abut and mate with complementary features formed on the ratchet wheel 440 to provide additional security in translating the strap 1103 via rotation of the ratchet wheel 440.

In an embodiment, the ratchet wheel 440 is configured to abut the strap 1103 and translate the strap 1103 laterally (towards the left or right direction) by a rotation of the ratchet wheel 440. To this end, the ratchet button 455 is disposed on an external surface of the housing cap 415 and configured to move in a direction towards and away from the ratchet wheel 440. To rotate the ratchet wheel 440, the ratchet button 445 is mechanically mated to the ratchet wheel 440 and configured to be depressed to cause a rotation or ratcheting of the ratchet wheel 440. For example, a series of gears and screws can translate the linear motion of the ratchet button 445 to the rotation of the ratchet wheel 440. The depression of the ratchet button 445 additionally and simultaneously overcome a retention of the strap 1103 in the current position via the locking pawl 450. The locking pawl 450 is configured to contact the ratchet wheel 440 and prevent the rotation of the ratchet wheel 440. The locking pawl 450 can be biased towards the ratchet wheel 440 via, for example, a spring force or a magnetic force. Notably, the depression of the ratchet button 445 can result in a greater biasing force than a locking force of the locking pawl 450 on the ratchet wheel 440 to rotate the ratchet wheel 440 and thus translate the strap 1103. It may be appreciated that the ratchet button 445 can be disposed along other external surfaces of the motion stabilizer device 150, such as along an external surface of the handle portion 151 so the user can use a finger to depress the ratchet button 445.

In an embodiment, the locking pawl 450 is configured to contact the strap 1103 and prevent the translation of the strap 1103 (and by association, prevents the rotation of the ratchet wheel 440). The locking pawl 450 can be biased towards the strap 1103 via, for example, a spring force or a magnetic force. Notably, the depression of the ratchet button 445 can result in a greater biasing force than a locking force of the locking pawl 450 on the strap 1103 to allow translation of translate the strap 1103.

In an embodiment, the ratchet button 445 is configured to return to a starting position via, for example, a spring or magnetic force upon reduction of the force to depress the ratchet button 445. Thus, the ratchet button 445 can be depressed multiple times in order to rotate the ratchet wheel 440 (and release the locking pawl 450) to translate the strap 1103. Each time the ratchet button 445 is depressed, the ratchet wheel 440 rotates and translates the strap 1103. Then, the locking pawl 450 prevents additional translation of the strap 1103 indirectly by preventing rotation of the ratchet wheel 440 and/or directly by preventing translation of the strap 1103, e.g., via friction.

In an embodiment, the multiple depressions of the ratchet button 445 tightens the strap 1103 around the user's hand. For example, the user can grasp the motion stabilizer device 150 along the handle portion 151, arrange the ratchet button 445 proximal to a flat surface, such as a table, and apply a force towards the flat surface to depress the ratchet button 445 as many times as needed to translate the strap 1103 and tighten the strap 1103 around the user's hand. Upon reaching a desired fit, the user can stop depressing the ratchet button 445.

In an embodiment, the motion stabilizer device 150 can include a loosening feature, such as another button, that the user can engage to release or unlock the ratchet wheel 440 from the strap 1103 or the locking pawl 450 from the strap 1103, thereby allowing the strap 1103 to move freely.

In an embodiment, a force can be applied on the strap 1103 in the opposite direction that overcomes the locking force of the locking pawl 450 on the ratchet wheel 440, the locking force of the locking pawl 450 on the strap 1103, or the locking force (e.g., a friction force) between the ratchet wheel 440 and the strap 1103. For example, the user can secure the motion stabilizer device 150 between the user's legs and pull the user's hand away from the motion stabilizer device 150 to pull the strap 1103 away from the stabilizer device 150, which overcomes any locking force on the strap 1103 and loosens the strap 1103.

Figure 8:
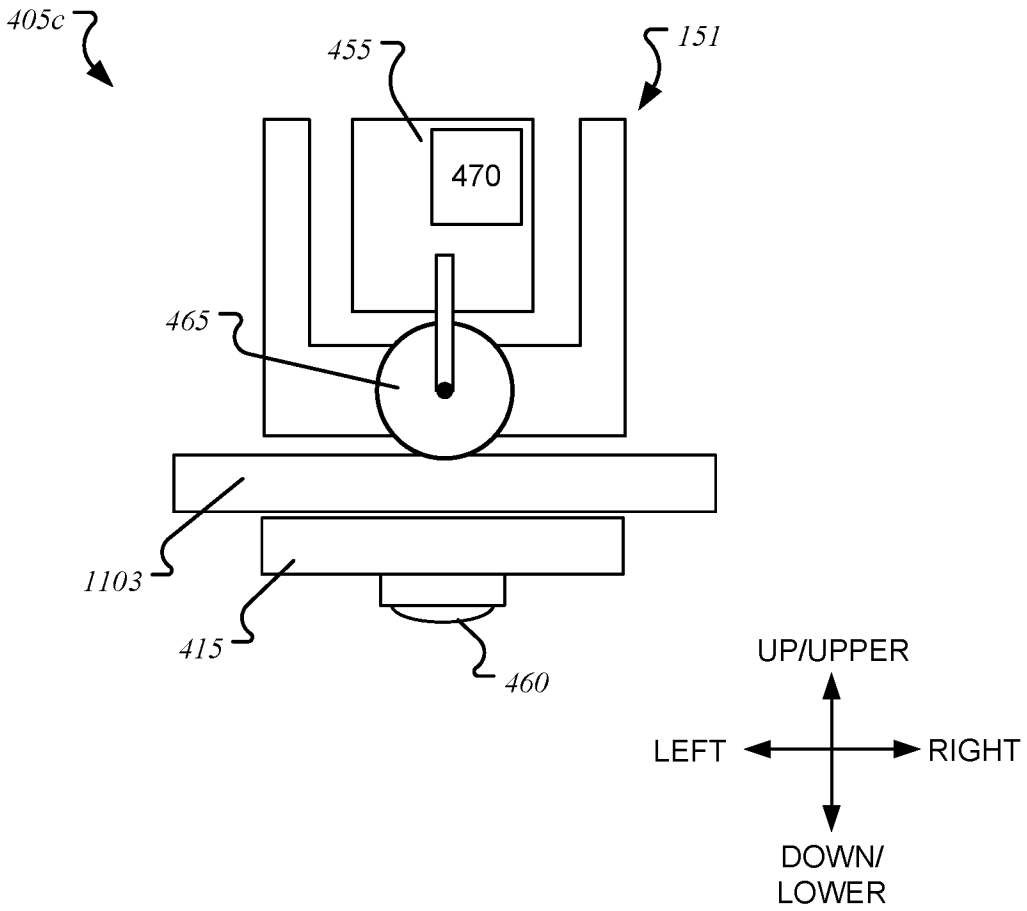
FIG. 8 shows an illustration of a strap adjustment system with automated strap adjustment, according to an embodiment of the present disclosure.

FIG. 8 shows an illustration of a strap adjustment system 405*d* with automated strap adjustment, according to an embodiment of the present disclosure. In an embodiment, the strap adjustment system 405*d* includes a motor 455, an adjustment wheel 465 connected to the motor 455, processing circuitry, and a button 460. The strap 1103 passes through the first opening and the second opening formed between the handle portion 151 and the housing cap 415. The wheel 465 is disposed adjacent to the strap 1103, such as disposed along the handle portion 151, and contacts the strap 1103 on the second side of the strap 1103 (as shown). In an embodiment, the wheel 465 is disposed along the housing cap 415 and contacts the strap 1103 on the first side of the strap 1103. As shown, the wheel 465 pushes the strap 1103 towards the housing cap 415 to achieve sufficient friction between the wheel 465 and the strap 1103. As described previously, the strap 1103 can optionally include the teeth that can abut and mate with complementary features formed on the wheel 465 to provide additional security in translating the strap 1103 via rotation of the wheel 465.

The motor 455 can be disposed in the handle portion 151, such as at an end of the handle portion 151 proximal to the strap 1103. The processing circuitry is electrically connected to the motor 455 and the button 460 and configured to actuate the motor 455. The button 460 is disposed, for example, along the external surface of the housing cap 415 (as shown) or another external surface of the motion stabilizer device 150 where the user can actuate the button 460 with the user's finger.

In an embodiment, the button 460 is electrically connected to the processing circuitry and configured to send an electronic signal to the processing circuitry to actuate the motor 455 upon being depressed. The motor 455, being mechanically connected to the adjustment wheel 465, rotates the adjustment wheel 465 to translate the strap 1103. Again, the motor 455 (similar to the ratchet wheel 440 and the ratchet button 445) can be mechanically connected to the adjustment wheel 465 via a set of gears and/or screws that translate a mechanical output of the motor 455 to a rotation of the adjustment wheel 465.

In an embodiment, depressing the button 460 according to predetermined patterns can result in different actuations of the motor 455. For example, a single depression of the button 460 can cause the motor 455 to translate the strap 1103 in a first direction and a double-depression in quick succession of the button 460 can cause the motor to translate the strap 1103 in a second direction. In doing so, the single or double depression can tighten or loosen the strap. The motor 455 can be configured to run for a predetermined length of time or continuously until another action on the button 460 is performed. For example, after the double-depression of the button 460, the motor 455 can run and rotate the adjustment wheel 465 until the button 460 is depressed again (e.g., a single depression or another double-depression), at which point the motor 455 can stop.

In an embodiment, the motor 455 includes a force sensor 470 configured to determine a resistance force of the motor 455 as it acts upon the adjustment wheel 465 and thus the strap 1103. For example, the motor 455 can be rotating the adjustment wheel 465 to tighten the strap 1103 on the user's hand and, upon the force sensor 470 detecting a resistance threshold has been reached, the force sensor 470 can stop the motor 455. In doing so, the strap 1103 will not be tightened beyond a predetermined force and reduces the likelihood of injuring the user.

In an embodiment, the PCBA 1302 is communicatively coupled to a remote processing device and configured to update the remote processing device with regards to the arrangement of the motion stabilizer device 150 and other components, such as the button 460 and its actuation. In an embodiment, the remote processing device is configured to receive data from the PCBA 1302 and transmit instructions to the PCBA 1302 based on the arrangement of the motion stabilizer device 150. In an embodiment, the remote processing device is configured to receive input from the user regarding arrangement settings, such as a setting for the button 460 actuation and/or the resistance threshold before instructing the PCBA 1302 to adjust the strap 1103 (e.g., via the motor 455). In an embodiment, the PCBA 1302 (via the included sensors) detects the unlocking force and other related sensor data and transmits the related sensor data to the remote processing device and awaits receiving instructions from the remote processing device based on the related sensor data. Upon receiving the instructions from the remote processing device, such as to tighten or loosen the strap via the motor 455 based on the related sensor data, the PCBA 1302 adjusts the strap 1103.

Figure 9:
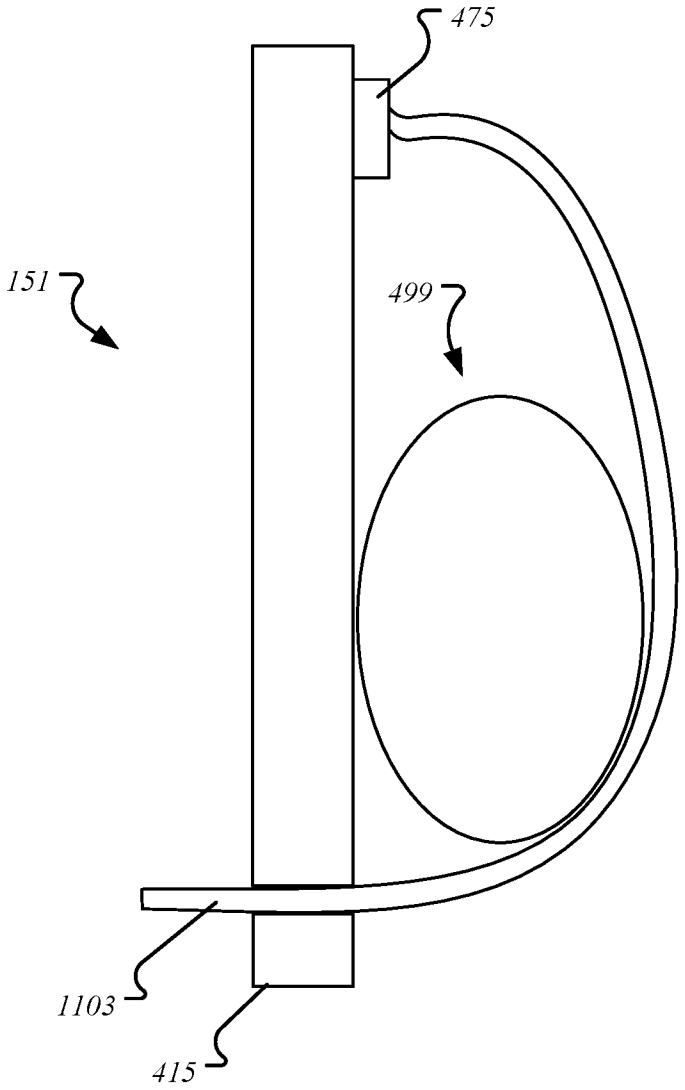
FIG. 9 shows an illustration of the strap adjustment system with the adjustable or dynamic attachment of the strap, according to an embodiment of the present disclosure.
Figure 9:
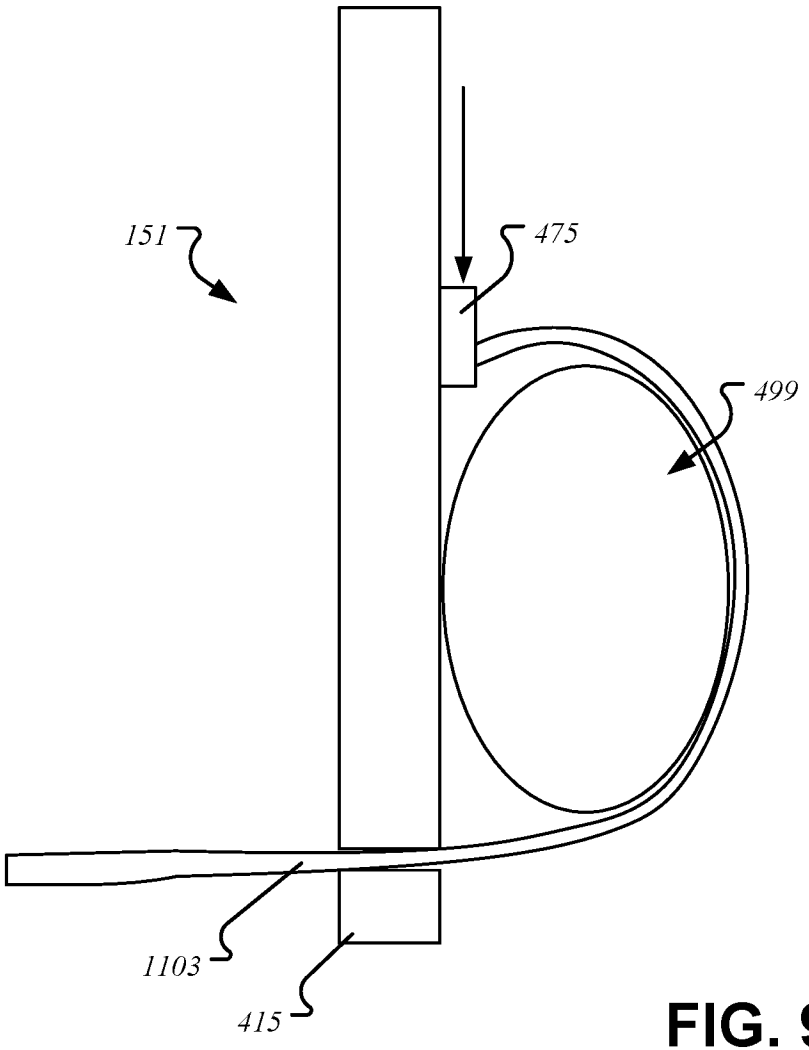

FIG. 9 shows an illustration of the strap adjustment system 405 with the adjustable or dynamic attachment of the strap 1103, according to an embodiment of the present disclosure. In an embodiment, as previously described, the location of the attachment of the first end of the strap 1103 can be dynamic or adjustable in order to allow further customization according to the width of the user's hand. As shown, the strap 1103 is attached or fastened to an adjustable strap attachment 475 and loops around the back of a hand 499. The user can tighten the strap 1103 to the first resistance checkpoint where the strap 1103 is taught against the back of the user's hand (e.g., by rolling the roller wheel 420, ratcheting the strap 1103 via the ratchet button 445, actuating the motor 455 via the button 460, etc.). At this point, the first end of the strap 1103 at the adjustable strap attachment 475 can have remained in the same position. Then, additional efforts to tighten the strap 1103 results in translation of the adjustable strap attachment 475 (and thus the first end of the strap 1103) towards the housing cap 415. This reduces the diameter of the loop along an axis of the motion stabilizer device 150 for a more secure or snug fit with a narrow width around the hand 499. For example, the strap 1103 and the adjustable strap attachment 475 can be translated to a second resistance checkpoint where additional tightening of the strap 1103 is prevented to avoid injury.

In one embodiment, the present disclosure relates to a strap adjustment system for a cosmetic applicator configured for users with limited mobility, including a housing cap disposed at an end of the cosmetic applicator, the housing cap and the end of the cosmetic applicator forming a chamber including a first opening and a second opening; a strap attached to the cosmetic applicator at a first end of the strap, a second end of the strap configured to pass through the first opening and the second opening; a locking feature disposed on a first side of the chamber and configured to (i) contact a first side of the strap, (ii) bias the strap in a first direction away from the first side of the chamber via a locking force, and (iii) force a second side of the strap to abut a first locking edge and a second locking edge of the chamber formed, the first locking edge formed as part of the first opening of the chamber and second locking edge formed as part of the second opening of the chamber, the locking force preventing translation of the strap through the chamber; and a roller wheel disposed on a second side of the chamber opposite the first side of the chamber, the roller wheel configured to (i) abut the second side of the strap when an unlocking force is applied in a second direction opposite the first direction to force the roller wheel into an engaged state, the unlocking force being sufficient to overcome the locking force applied by the locking feature and allow the strap to translate through the chamber, (ii) rotate in the engaged state to translate the strap through the chamber, and (iii) return to an unengaged state where the roller wheel does not provide sufficient unlocking force to overcome the locking force applied by the locking feature on the strap.

In an embodiment, the locking feature is a reversibly deformable structure configured to apply the locking force in the first direction via a spring force.

In an embodiment, the locking feature is a magnet configured to apply the locking force in the first direction via a magnetic force.

In an embodiment, the strap is reversibly deformed in the chamber via the locking force applied by the locking feature, the deformation of the strap increasing a friction force between the strap at the first locking edge and the second locking edge.

In an embodiment, the roller wheel is reversibly biased away from the strap in the first direction.

In an embodiment, the roller wheel includes an axle disposed through a rotation axis of the roller wheel, a first end of the axle and a second end of the axle being disposed in a first axle housing and a second axle housing, respectively, formed as part of the second side of the chamber, the first axle housing and the second axle housing each including an elongated opening along the first and second direction through which the first end of the axle and the second end of the axle can travel between the engaged and unengaged states of the roller wheel.

In an embodiment, the roller wheel is arranged on a swiveling platform formed as part of the second side of the chamber, the swiveling platformed configured to rotate about an axis orthogonal to a rotation axis of the roller wheel and rotate the roller wheel along a direction of an applied force applied to the roller wheel.

In an embodiment, the strap includes friction features on the second side of the strap configured to provide additional resistance force against translation of the strap through the chamber.

In an embodiment, the roller wheel includes complementary friction features as the friction features on the second side of the strap, the complementary friction features of the roller wheel being disposed on a surface of the roller wheel and configured to abut and mate with the friction features of the strap.

In an embodiment, the roller wheel is configured to translate the strap to a first resistance checkpoint.

In an embodiment, the first end of the strap is attached to the cosmetic applicator via an adjustable strap attachment configured to reversibly translate in the first direction and the second direction.

In an embodiment, after reaching the first resistance check point, the roller wheel is configured to further translate the strap through the chamber and adjust an arrangement of the adjustable strap attachment along the first and second direction.

In an embodiment, the roller wheel is configured to translate the strap to a second resistance checkpoint after which a tightness of the strap around an object disposed within a loop of the strap cannot be tightened further.

The present disclosure additionally relates to a method of adjusting a strap in a strap adjustment system for a cosmetic applicator configured for users with limited mobility, including applying an unlocking force towards a housing cap disposed at an end of the cosmetic applicator, the housing cap and the end of the cosmetic applicator forming a chamber including a first opening and a second opening, the strap attached to the cosmetic applicator at a first end of the strap, a second end of the strap configured to pass through the first opening and the second opening, the strap adjustment system additionally including a locking feature disposed on a first side of the chamber and configured to (i) contact a first side of the strap, (ii) bias the strap in a first direction away from the first side of the chamber via a locking force, and (iii) force a second side of the strap to abut a first locking edge and a second locking edge of the chamber formed, the first locking edge formed as part of the first opening of the chamber and second locking edge formed as part of the second opening of the chamber, the locking force preventing translation of the strap through the chamber, and a roller wheel disposed on a second side of the chamber opposite the first side of the chamber, the roller wheel configured to (i) abut the second side of the strap when the unlocking force is applied in a second direction opposite the first direction to force the roller wheel into an engaged state, the unlocking force being sufficient to overcome the locking force applied by the locking feature and allow the strap to translate through the chamber, (ii) rotate in the engaged state to translate the strap through the chamber, and (iii) return to an unengaged state where the roller wheel does not provide sufficient unlocking force to overcome the locking force applied by the locking feature on the strap; and while applying the unlocking force towards the housing cap sufficient to overcome the locking force, applying a lateral force to rotate the roller wheel and translate the strap through the chamber.

Obviously, numerous modifications and variations of the present invention are possible in light of the above teachings. It is therefore to be understood that within the scope of the appended claims, the invention may be practiced otherwise than as specifically described herein.

The invention claimed is:

1. A strap adjustment system for a cosmetic applicator configured for users with limited mobility, comprising:

a housing cap disposed at an end of the cosmetic applicator, the housing cap and the end of the cosmetic applicator forming a chamber including a first opening and a second opening;

a strap attached to the cosmetic applicator at a first end of the strap, a second end of the strap configured to pass through the first opening and the second opening;

a locking feature disposed on a first side of the chamber and configured to (i) contact a first side of the strap, (ii) bias the strap in a first direction away from the first side of the chamber via a locking force, and (iii) force a second side of the strap to abut a first locking edge and a second locking edge of the chamber formed, the first locking edge formed as part of the first opening of the chamber and second locking edge formed as part of the second opening of the chamber, the locking force preventing translation of the strap through the chamber; and a roller wheel disposed on a second side of the chamber opposite the first side of the chamber, the roller wheel configured to (i) abut the second side of the strap when an unlocking force is applied in a second direction opposite the first direction to force the roller wheel into an engaged state, the unlocking force being sufficient to overcome the locking force applied by the locking feature and allow the strap to translate through the chamber, (ii) rotate in the engaged state to translate the strap through the chamber, and (iii) return to an unengaged state where the roller wheel does not provide sufficient unlocking force to overcome the locking force applied by the locking feature on the strap.

2. The system of claim 1, wherein the locking feature is a reversibly deformable structure configured to apply the locking force in the first direction via a spring force.

3. The system of claim 1, wherein the locking feature is a magnet configured to apply the locking force in the first direction via a magnetic force.

4. The system of claim 1, wherein the strap is reversibly deformed in the chamber via the locking force applied by the locking feature, the deformation of the strap increasing a friction force between the strap at the first locking edge and the second locking edge.

5. The system of claim 1, wherein the roller wheel is reversibly biased away from the strap in the first direction.

6. The system of claim 5, wherein the roller wheel includes an axle disposed through a rotation axis of the roller wheel, a first end of the axle and a second end of the axle being disposed in a first axle housing and a second axle housing, respectively, formed as part of the second side of the chamber, the first axle housing and the second axle housing each including an elongated opening along the first and second direction through which the first end of the axle and the second end of the axle can travel between the engaged and unengaged states of the roller wheel.

7. The system of claim 1, wherein the roller wheel is arranged on a swiveling platform formed as part of the second side of the chamber, the swiveling platformed configured to rotate about an axis orthogonal to a rotation axis of the roller wheel and rotate the roller wheel along a direction of an applied force applied to the roller wheel.

8. The system of claim 1, wherein the strap includes friction features on the second side of the strap configured to provide additional resistance force against translation of the strap through the chamber.

9. The system of claim 8, wherein the roller wheel includes complementary friction features as the friction features on the second side of the strap, the complementary friction features of the roller wheel being disposed on a surface of the roller wheel and configured to abut and mate with the friction features of the strap.

10. The system of claim 1, wherein the roller wheel is configured to translate the strap to a first resistance checkpoint.

11. The system of claim 10, wherein the first end of the strap is attached to the cosmetic applicator via an adjustable strap attachment configured to reversibly translate in the first direction and the second direction.

12. The system of claim 11, wherein after reaching the first resistance check point, the roller wheel is configured to further translate the strap through the chamber and adjust an arrangement of the adjustable strap attachment along the first and second direction.

13. The system of claim 12, wherein the roller wheel is configured to translate the strap to a second resistance checkpoint after which a tightness of the strap around an object disposed within a loop of the strap cannot be tightened further.

14. A method of adjusting a strap in a strap adjustment system for a cosmetic applicator configured for users with limited mobility, comprising:

applying an unlocking force towards a housing cap disposed at an end of the cosmetic applicator, the housing cap and the end of the cosmetic applicator forming a chamber including a first opening and a second opening, the strap attached to the cosmetic applicator at a first end of the strap, a second end of the strap configured to pass through the first opening and the second opening, the strap adjustment system additionally including a locking feature disposed on a first side of the chamber and configured to (i) contact a first side of the strap, (ii) bias the strap in a first direction away from the first side of the chamber via a locking force, and (iii) force a second side of the strap to abut a first locking edge and a second locking edge of the chamber formed, the first locking edge formed as part of the first opening of the chamber and second locking edge formed as part of the second opening of the chamber, the locking force preventing translation of the strap through the chamber, and a roller wheel disposed on a second side of the chamber opposite the first side of the chamber, the roller wheel configured to (i) abut the second side of the strap when the unlocking force is applied in a second direction opposite the first direction to force the roller wheel into an engaged state, the unlocking force being sufficient to overcome the locking force applied by the locking feature and allow the strap to translate through the chamber, (ii) rotate in the engaged state to translate the strap through the chamber, and (iii) return to an unengaged state where the roller wheel does not provide sufficient unlocking force to overcome the locking force applied by the locking feature on the strap; and while applying the unlocking force towards the housing cap sufficient to overcome the locking force, applying a lateral force to rotate the roller wheel and translate the strap through the chamber.

15. The method of claim 14, wherein the locking feature is a reversibly deformable structure configured to apply the locking force in the first direction via a spring force.

16. The method of claim 14, wherein the locking feature is a magnet configured to apply the locking force in the first direction via a magnetic force.

17. The method of claim 14, wherein the strap is reversibly deformed in the chamber via the locking force applied by the locking feature, the deformation of the strap increasing a friction force between the strap at the first locking edge and the second locking edge.

18. The method of claim 14, wherein the roller wheel is arranged on a swiveling platform formed as part of the second side of the chamber, the swiveling platformed configured to rotate about an axis orthogonal to a rotation axis of the roller wheel and rotate the roller wheel along the applied lateral force.

19. The method of claim 14, wherein the first end of the strap is attached to the cosmetic applicator via an adjustable strap attachment configured to reversibly translate in the first direction and the second direction.

20. The method of claim 19, wherein applying the lateral force further comprises applying the lateral force to a first resistance checkpoint where the strap tightens, to a first predetermined resistance force, around an object disposed in a loop of the strap while the adjustable strap adjustment remains in a first arrangement; and applying a second lateral force in the same direction as the lateral force to adjust the adjustable strap adjustment towards the object to further righten the strap around the object until a second resistance checkpoint is reached having a second predetermined resistance force that arranges the adjustable strap adjustment in a second arrangement.

* * * * *